US008836455B2

(12) United States Patent
Gu et al.

(10) Patent No.: US 8,836,455 B2
(45) Date of Patent: Sep. 16, 2014

(54) SOFT-COLLISION ELECTROMAGNETIC DRIVING MECHANISM

(75) Inventors: Mingfeng Gu, Jiangsu (CN); Boyi Shi, Jiangsu (CN)

(73) Assignee: Jiangsu Modern Electric Technology Co., Ltd., Jiangsu (CN)

( * ) Notice: Subject to any disclaimer, the term of this patent is extended or adjusted under 35 U.S.C. 154(b) by 0 days.

(21) Appl. No.: 13/883,261

(22) PCT Filed: Nov. 3, 2011

(86) PCT No.: PCT/CN2011/001856

§ 371 (c)(1), (2), (4) Date: May 2, 2013

(87) PCT Pub. No.: WO2012/058867

PCT Pub. Date: May 10, 2012

(65) Prior Publication Data

US 2013/0222083 A1 Aug. 29, 2013

(30) Foreign Application Priority Data

Nov. 3, 2010 (CN) ..... 2010 1 0530843

(51) Int. Cl.

| | |
|---|---|
| ***H01H 51/30*** | (2006.01) |
| ***H01H 9/00*** | (2006.01) |
| ***H01H 3/28*** | (2006.01) |
| ***H01H 36/00*** | (2006.01) |
| ***H01H 3/32*** | (2006.01) |
| *H01H 3/60* | (2006.01) |

(52) U.S. Cl.

CPC ..... *H01H 36/00* (2013.01); *H01H 3/28* (2013.01); *H01H 3/605* (2013.01); *H01H 3/60* (2013.01); *H01H 3/32* (2013.01)

USPC ..... 335/105; 335/179

(58) Field of Classification Search

USPC ..... 335/2, 99, 105, 177, 179, 185, 187, 335/193, 220, 243, 247, 248, 257, 271, 277

See application file for complete search history.

(56) References Cited

U.S. PATENT DOCUMENTS 3,543,204 A * 11/1970 Cox et al. ..... 335/267
4,779,582 A * 10/1988 Lequesne ..... 123/90.11

(Continued)

FOREIGN PATENT DOCUMENTS

CN 2485779 Y 4/2002
CN 201060793 Y 5/2008

(Continued)

*Primary Examiner* — Bernard Rojas

(74) *Attorney, Agent, or Firm* — Muncy, Geissler, Olds & Lowe, P.C.

(57) ABSTRACT

A soft-collision electromagnetic driving mechanism comprises a movable shaft driven by an electromagnetic mechanism, wherein the movable shaft is fixed to a movable iron core, an upper part of the movable shaft is connected to a movable damping mechanism, the movable damping mechanism comprises a first cylinder, the first cylinder has a movable damping piston therein, the movable damping piston is formed by a damping piston head and damping piston rods disposed at two sides of the damping piston head, first and second sealing chambers are at the two sides of the damping piston head respectively, a damping liquid is filled in the first and second sealing chambers, and a two-way discharge channel is arranged between the first and second sealing chambers. The driving mechanism is a permanent magnetic linear driving mechanism having a simple structure, a strong driving force and smooth contact, which can be used to drive electrical switches or devices requiring smooth contact, strong driving force and high speed.

10 Claims, 1 Drawing Sheet

(56) References Cited

U.S. PATENT DOCUMENTS

| | | | | |
|---|---|---|---|---|
| 5,131,624 | A * | 7/1992 | Kreuter et al. | 251/129.18 |
| 6,279,524 | B1 * | 8/2001 | Schebitz | 123/90.11 |
| 6,289,858 | B1 * | 9/2001 | Altdorf et al. | 123/90.11 |
| 6,927,656 | B2 * | 8/2005 | Iwata et al. | 335/220 |

FOREIGN PATENT DOCUMENTS

| | | | |
|---|---|---|---|
| CN | 201181639 | Y | 1/2009 |
| CN | 102054606 | A | 5/2011 |
| JP | S 5014960 | U | 2/1975 |
| JP | 9139166 | A | 5/1997 |
| JP | 9250653 | A | 9/1997 |
| JP | 11040012 | A | 2/1999 |

* cited by examiner

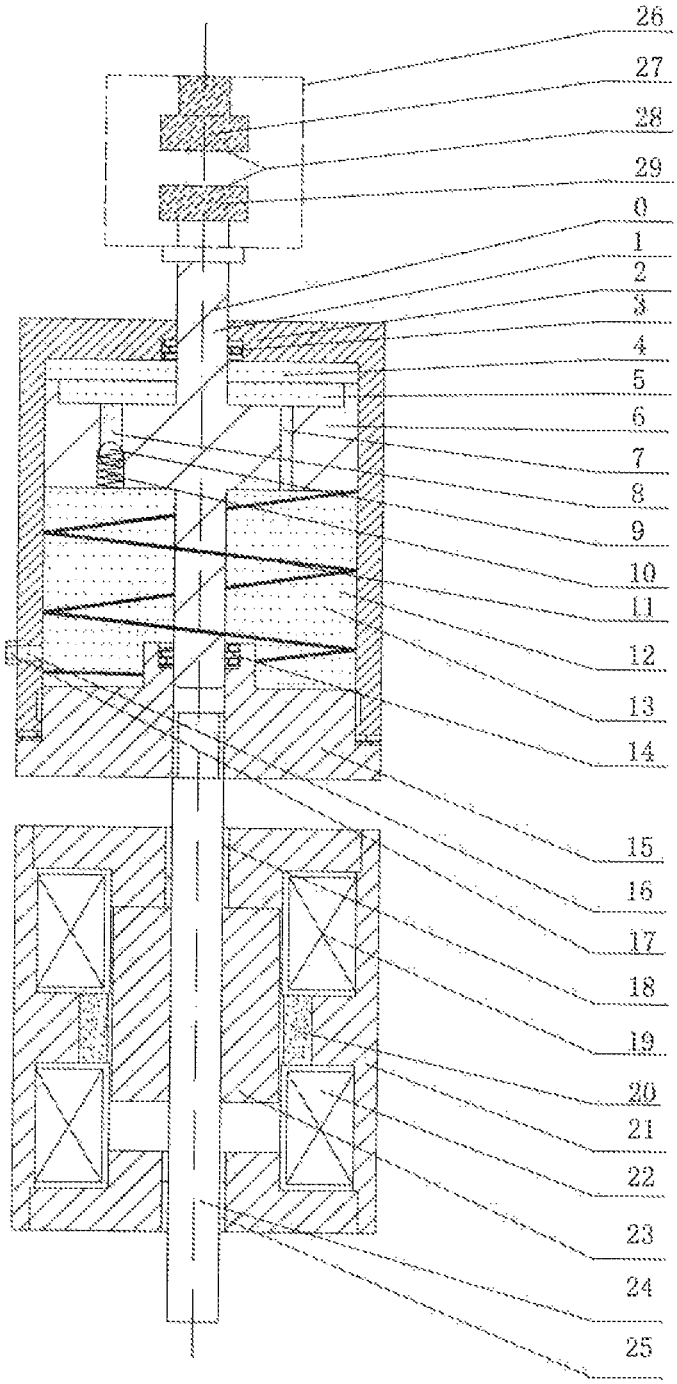
26
27
28
29
0
1
2
3
4
5
6
7
8
9
10
11
12
13
14
15
16
17
18
19
20
21
22
23
24
25

SOFT-COLLISION ELECTROMAGNETIC DRIVING MECHANISM

The present application is the national stage of International Application No.: PCT/CN2011/001856, which was filed on Nov. 3, 2010 and which depends on and claims the right of priority of the Chinese patent application 2010105308414 filed on Nov. 3, 2010. The entire contents of both are incorporated herein by reference.

FIELD OF THE INVENTION

The present invention, which relates to the field of power switch apparatus driven by electromagnetism, is a soft-collision electromagnetic driving mechanism.

DESCRIPTION OF THE RELATED ART

In the case of strong driving force or high driving speed, the existing electromagnetic driving mechanisms suffer from strong impact force and severe bounce when their movements are hindered. When such electromagnetic driving mechanisms are used to constitute an electrical switch apparatus, arc discharge and reignition between moving and stationary contacts of the electrical switch are apt to occur, and thus the electrical quality is affected seriously. On the other hand, rigid contact will result in violent collision which causes damage to the surfaces of the moving and stationary contacts of the electrical switch and greatly shortens the mechanical life span of the apparatus. Moreover, when rigid collision happens, a loud noise is made, affecting the environment,

SUMMARY OF THE INVENTION

The object of the present invention is to provide a soft-collision electromagnetic driving mechanism having a simple structure, a strong driving force and smooth contact.

A soft-collision electromagnetic driving mechanism comprises a movable shaft driven by an electromagnetic mechanism, wherein the movable shaft is fixed to a movable iron core, an upper end of the movable shaft is connected to a movable damping mechanism, the movable damping mechanism comprises a first cylinder, the first cylinder has a movable damping piston therein, the movable damping piston is formed by a damping piston head and damping piston rods disposed at two sides of the damping piston head, first and second sealing chambers are at the two sides of the damping piston head respectively, a damping liquid is filled in the first and second sealing chambers, and a two-way discharge channel is arranged between the first and second sealing chambers.

The electromagnetic mechanism comprises a second cylinder, a permanent magnet, the movable shaft and a movable iron core, and drive coils. The permanent magnet surrounds the movable shaft and is fixed to an inner side of the second cylinder, and the coils are provided in the second cylinder.

The drive coils of the electromagnetic mechanism comprise a first coil and a second coil. The first and the second coils both surround the movable shaft and abut against the inner side of the second cylinder. The permanent magnet is located between the first and the second coils, and the movable iron core moves in an axial direction within the second cylinder.

The damping piston head, the damping piston rod and the movable shaft are on the same axis. The movable shaft is connected to a lower end lid or a lower end of the first cylinder. The axial projected area of the two-way discharge channel between the first and the second sealing chambers is smaller than 10% of the axial projected area of the damping piston head.

At least one of the first and the second sealing chambers is provided with a spring. The spring directly or indirectly presses the damping piston head.

At least one end face of the damping piston head has a groove.

The damping piston head has at least one one-way discharge valve.

The permanent magnet is an annular magnet, or is at least two sectorial magnets that are evenly distributed around the movable shaft.

The size of the movable iron core satisfies the following condition: in any position, the upper and the lower ends of the movable iron core are respectively surrounded by the first and the second coils at the same time.

The movable shaft and the movable iron core are made of different metal materials.

The permanent magnetic linear driving mechanism of the present invention, which has a simple structure, a strong driving force and smooth contact, can be used to drive electrical switches or devices requiring smooth contact, strong driving force and high speed.

BRIEF DESCRIPTION OF THE DRAWING

The present invention will be described in detail with reference to exemplary embodiments and accompanying drawings.

FIG. 1 is a view showing the structure of a soft-collision electromagnetic driving mechanism according to an embodiment of the present invention.

DESCRIPTION OF REFERENCE NUMERALS

0—damping piston
1—damping piston rod
2—cylinder
3—sealing member
4—sealing chamber
5—groove on the piston
6—damping piston head
7—two-way discharge channel
8—one-way discharge valve
9—pellet
10—one-way discharge valve spring
11—spring
12—damping liquid
13—sealing chamber II
14—sealing member II
15—lower end lid of the cylinder I
16—hole for injecting the damping liquid
17—sealing member III
18—bush I
19—drive coil I
20—permanent magnet
21—cylinder II
22—drive coil II
23—movable iron core
24—movable shaft
25—bush II
26—electrical switch
27—stationary contact of the electrical switch
28—contact surface of the electrical switch
29—moving contact of the electrical switch

DETAILED DESCRIPTION OF THE PREFERRED EMBODIMENT

The driving mechanism consists of a movable shaft 24, a permanent magnet 20, drive coils 19 and 22, a damping piston 0, a damping liquid 12, etc. The permanent magnet 20, the drive coils 19 and 22, the damping piston 0 and the damping liquid 12 are arranged along a driving direction. The damping piston consists of a damping piston head 6 and damping piston rods 1 disposed at two sides of the damping piston head.

The damping piston 0 is provided in a cylinder I 2 into which a damping liquid 12 is injected, and comes in contact with the damping liquid 12. The movable shaft 24 is fixed to a movable iron core 23. The movable shaft and the movable iron core pass through the two drive coils 19 and 22. The damping piston rod 1 and the movable shaft 24 are directly or indirectly connected to each other in a linear direction.

The movable damping piston 0 consists of the damping piston head 6 and the damping piston rods 1 disposed at two sides of the damping piston head. The damping piston head and the damping piston rods are on the same axis. The damping piston head has a two-way discharge channel 7 therein. The axial projected area of the two-way discharge channel 7 cannot be too large and preferably be smaller than 10% of the axial projected area of the damping piston head; otherwise, the damping effect should be affected.

The damping liquid 12 and the damping piston head 6 are in a closed chamber. The damping piston head divides the closed chamber into two chambers 4 and 13 which are connected to each other by the two-way discharge channel 7 in the damping piston head. The two chambers 4 and 13 are filled with the damping liquid that may flow through the two-way damping channel. One of the chambers 4 and 13 is provided with a spring 11 which presses the damping piston head. A hole 16 for the injection of the damping liquid is provided in the cylinder wall of one of the chambers 4 and 13 and is sealed by a sealing member 17. The space between the damping piston rod 1 and the cylinder I and the space between the damping piston rod 1 and the lower end lid of the cylinder I are sealed by sealing members 3 and 14, respectively, so as to prevent leakage of the damping liquid or entrance of air.

The damping piston head 6 has a one-way discharge valve 8 which consists of a pellet 9 and a spring 10. The damping liquid 12 can only flow in one direction in the one-way discharge valve, thereby achieving different damping effects during the reciprocation of the damping liquid.

A movable iron core 23 made of a ferromagnetic material is fixed to the movable shaft 24, and moves axially in a cylindrical cylinder II 21 made of a ferromagnetic material.

A permanent magnet 20 is fixed to an intermediate position in an axial direction of the inner wall of the cylindrical cylinder II 21. The upper and the lower sides of the permanent magnet are provided with drive coils 19 and 22, respectively. The permanent magnet may be an annular magnet or at least two sectorial magnets. The magnetic poles at the inner and the outer sides of the annular or sectorial permanent magnet are opposite to each other, which makes the attraction between the cylinder II 21 and the movable iron core 23 the strongest and the magnetic holding capability between them the best.

The size of the movable iron core 23 which moves axially in the cylindrical cylinder II 21 satisfies the following condition: in any position, the upper and the lower ends of the movable iron core are respectively surrounded by two drive coils so that the movable iron core 23 can be magnetized more easily when the drive coils are electrified and a stronger driving force can thus be produced. The movable shaft and the movable iron core are made of different metal materials. The movable shaft is made of a non magnet-conductible material while the movable iron core is made of a magnet-conductible material, such that the strongest magnetic holding force can be produced when the end face of the movable, iron core comes in contact with one of the inner ends of the cylinder II.

The damping piston rod 1 of the soft-collision electromagnetic driving mechanism is connected to a moving contact 29 of the electrical switch.

The working principle of the present invention:

(1) The Principle of the Injection of the Damping Liquid

Opening a sealing member III 17 which seals the hole for the injection of the damping liquid, injecting the damping liquid into the sealing chambers I 4 and II 13, and sealing the above hole again with the sealing member III 17.

If a small quantity of air exists during the injection of the damping liquid, the small quantity of air will be stored in a groove on the upper end face of the piston and thus won't affect the damping property.

(2) The Working Principle of the Drive

1) The principle of the upward movement of the movable shaft and the principle of maintaining attraction after the upward movement When the movable iron core 23 is at the lower part of the cylinder II 21, the drive coil I 19 is electrified to generate a magnetic field. Hence, the upper end of the cylinder produces strong attraction to the movable iron core, and this attraction is greater than the holding attraction between the movable iron core and the lower end of the cylinder II. At this time, the movable iron core 23 moves upward→the movable shaft 24 moves upward→the cylinder I 2 moves upward→the damping liquid in the sealing chamber II 13 moves upward→the damping piston head 6 and the damping piston rod 1 move upward.

The movable iron core stops moving when it comes in contact with the inner end wall of the cylinder II. After the power is cut off, due to the presence of the permanent magnet 20, the end of the cylinder II 21 and the end of the movable iron core 23, which are in contact with each other, have different magnetic polarities, so the two end are held attracted to each other.

2) The downward movement of the movable shaft

When the movable iron core 23 is at the upper part of the cylinder II 21, the drive coil II 22 is electrified to generate a magnetic field. Hence, the lower end of the cylinder produces strong attraction to the movable iron core, and this attraction is greater than the holding attraction between the movable iron core and the upper end of the cylinder II. At this time, the movable iron core 23 moves downward→the movable shaft 24 moves downward→the cylinder I 2 moves downward→the damping liquid in the sealing chamber I 4 moves downward→the damping piston head 6 and the damping piston rod 1 move downward.

The movable iron core stops moving when it comes in contact with the inner end wall of the cylinder II. After the power is cut off, due to the presence of the permanent magnet 20, the end of the cylinder II 21 and the end of the movable iron core 23, which are in contact with each other, have different magnetic polarities, so the two end are held attracted to each other.

(3) The Working Principle of Soft Collision

Under the effect of the magnetic fields of the permanent magnet 20 and the drive coil I 19 or the drive coil II 22, the damping piston rod 1, the movable shaft 24 and the cylinder I 2 move in an axial direction; the moving contact 29 and the stationary contact 27 of the electrical switch come in contact with each other, the axial movement of the damping piston rod encounters a collision resistance, and the damping liquid 12 slowly passes through the two-way discharge channel 7 and flows to the other sealing chamber; during this process, the damping piston head constantly receives pressure from the damping liquid 12, so the damping piston rod 1 cannot rebound; and at the same time, due to the discharge of liquid by the two-way discharge channel 7, the impact force of the collision won't be too strong, thereby accomplishing soft collision between the moving contact of the electrical switch which is connected to the damping piston rod 1 and the stationary contact of the electrical switch.

(4) The Principle of Different Impact of Reciprocating Soft Collision

When the axial movement of the damping piston rod 1 encounters collision resistance, the presence of the two-way discharge channel 7 helps to achieve a soft collision. The damping piston head 6 further has a one-way discharge valve 8. When the damping piston rod 1 and the damping piston head 6 are moving, the one-way discharge valve 8 discharges the liquid only in one direction so that the discharge capability is improved in one direction and the impact from collision is relatively reduced. Thus, the impact of reciprocating soft collision is different.

(5) The Principle of the Control of the Electrical Switch and the Contact and Separation of the Contacts Under the effect of the electromagnetic driving force of the drive coil 19, the movable shaft moves upward, which causes the cylinder I 2, the damping piston rod 1 and the moving contact 29 of the electrical switch to move upward; and the moving contact and the stationary contact 27 of the electrical switch come in contact with each other, and the switch is turned on.

Under the effect of the electromagnetic driving force of the drive coil 22, the movable shaft moves downward, which causes the cylinder I 2, the damping piston rod 1 and the moving contact 29 of the electrical switch to move downward; and the moving contact and the stationary contact 27 of the electrical switch are separated from each other, and the switch is turned off.

What is claimed is:

1. A soft-collision electromagnetic driving mechanism comprising a movable shaft driven by an electromagnetic mechanism, wherein the movable shaft is fixed to a movable iron core, an upper part of the movable shaft is connected to a movable damping mechanism, the movable damping mechanism comprises a first cylinder, the first cylinder has a movable damping piston therein, the movable damping piston is formed by a damping piston head and damping piston rods disposed at two sides of the damping piston head respectively, first and second sealing chambers are at the two sides of the damping piston head, a damping liquid is filled in the first and second sealing chambers, and a two-way discharge channel is arranged between the first and second sealing chambers.

2. The soft-collision electromagnetic driving mechanism according to claim 1, wherein the electromagnetic mechanism comprises a second cylinder, a permanent magnet, the movable shaft and a movable iron core, and drive coils; and the permanent magnet surrounds the movable shaft and is fixed to an inner side of the second cylinder, and the drive coils are arranged in the second cylinder.

3. The soft-collision electromagnetic driving mechanism according to claim 2, wherein the drive coils of the electromagnetic mechanism comprise a first coil and a second coil which both surround the movable shaft and abut the inner side of the second cylinder; the permanent magnet is disposed between the first and the second coils; and the movable iron core moves axially in the second cylinder.

4. The soft-collision electromagnetic driving mechanism according to claim 1, wherein the damping piston head, the damping piston rods and the movable shaft are on the same axis; the movable shaft is connected to a lower end lid or a lower end of the first cylinder; and an axial projected area of the two-way discharge channel between the first and the second sealing chambers is smaller than 10% of an axial projected area of the damping piston head.

5. The soft-collision electromagnetic driving mechanism according to claim 1, wherein at least one of the first and the second sealing chambers is provided with a spring, and the spring directly or indirectly presses the damping piston head.

6. The soft-collision electromagnetic driving mechanism according to claim 1, wherein at least one end face of the damping piston head has a groove.

7. The soft-collision electromagnetic driving mechanism according to claim 1, wherein the damping piston head has at least one one-way discharge valve.

8. The soft-collision electromagnetic driving mechanism according to claim 3, wherein the permanent magnet is an annular magnet or is at least two sectorial magnets that are evenly distributed around the movable shaft.

9. The soft-collision electromagnetic driving mechanism according to claim 3, wherein a size of the movable iron core satisfies the following condition: in any position, upper and lower ends of the movable iron core are respectively surrounded by the first and the second coils simultaneity.

10. The soft-collision electromagnetic driving mechanism according to claim 1, wherein the movable shaft and the movable iron core are made of different metal materials.

* * * * *